US010997920B2

(12) United States Patent
Shi et al.

(10) Patent No.: US 10,997,920 B2
(45) Date of Patent: May 4, 2021

(54) PIXEL DRIVE CIRCUIT AND DRIVE METHOD, AND DISPLAY APPARATUS

(71) Applicant: BOE TECHNOLOGY GROUP CO., LTD., Beijing (CN)

(72) Inventors: Rongrong Shi, Beijing (CN); Shengji Yang, Beijing (CN); Wei Liu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/638,280

(22) PCT Filed: Apr. 12, 2019

(86) PCT No.: PCT/CN2019/082552

§ 371 (c)(1),
(2) Date: Feb. 11, 2020

(87) PCT Pub. No.: WO2019/214397

PCT Pub. Date: Nov. 14, 2019

(65) Prior Publication Data

US 2020/0184894 A1 Jun. 11, 2020

(30) Foreign Application Priority Data

May 8, 2018 (CN) ..... 201810435167.9

(51) Int. Cl.
*G09G 5/00* (2006.01)
*G09G 3/3258* (2016.01)

(52) U.S. Cl.
CPC ... *G09G 3/3258* (2013.01); *G09G 2300/0809* (2013.01); *G09G 2300/0876* (2013.01)

(58) Field of Classification Search
CPC ..... G09G 3/32; G09G 3/3225; G09G 3/3258; G09G 2300/0809; G09G 2300/0833;
(Continued)

(56) References Cited

U.S. PATENT DOCUMENTS

2004/0100430 A1 5/2004 Fruehauf
2009/0096818 A1* 4/2009 Nishimura ..... G09G 3/3291 345/690

(Continued)

FOREIGN PATENT DOCUMENTS

CN 102708785 A 10/2012
CN 103383835 A 11/2013

(Continued)

OTHER PUBLICATIONS

International Search Report and Written Opinion issued in corresponding International Application No. PCT/CN2019/082552, dated Jul. 3, 2019, with English language translation.

*Primary Examiner* — Joe H Cheng
(74) *Attorney, Agent, or Firm* — McDermott Will & Emery LLP

(57) ABSTRACT

A pixel drive circuit includes a drive unit, a boost sub-circuit and a light-emitting unit. The drive unit is configured to output a voltage; the boost sub-circuit is coupled to the drive unit and configured to receive and boost the voltage, and output a boosted voltage; and the light-emitting unit is coupled to the boost sub-circuit and configured to receive the boosted voltage.

18 Claims, 8 Drawing Sheets

(58) Field of Classification Search
CPC ... G09G 2300/0861; G09G 2300/0876; G09G 2310/0251; G09G 2310/0262; G09G 2320/0233
See application file for complete search history.

(56) References Cited

U.S. PATENT DOCUMENTS

| | | | | |
|---|---|---|---|---|
| 2009/0135165 | A1* | 5/2009 | Fukuzako | G09G 3/3283 345/204 |
| 2009/0219234 | A1* | 9/2009 | Yamamoto | G09G 3/3233 345/80 |
| 2010/0013869 | A1* | 1/2010 | Matsumoto | G09G 3/3666 345/690 |
| 2010/0182300 | A1* | 7/2010 | Kato | G09G 3/3696 345/211 |
| 2012/0139436 | A1* | 6/2012 | Park | G09G 3/3648 315/240 |
| 2012/0293482 | A1 | 11/2012 | Wu et al. | |
| 2014/0192094 | A1* | 7/2014 | Liao | G09G 3/3696 345/690 |
| 2014/0339507 | A1 | 11/2014 | Leobandung | |
| 2015/0130783 | A1* | 5/2015 | Toyomura | G09G 3/3258 345/213 |
| 2015/0279297 | A1* | 10/2015 | Nakano | G09G 3/3614 345/173 |
| 2015/0310807 | A1 | 10/2015 | Sun et al. | |
| 2016/0071445 | A1 | 3/2016 | Kim et al. | |
| 2016/0267837 | A1* | 9/2016 | Wang | G09G 3/3283 |
| 2017/0187920 | A1* | 6/2017 | Suzuki | H04N 1/40056 |
| 2017/0237877 | A1* | 8/2017 | Suzuki | H04N 1/401 358/446 |
| 2017/0271477 | A1 | 9/2017 | Palle et al. | |
| 2017/0337875 | A1 | 11/2017 | Jeon et al. | |
| 2017/0372663 | A1 | 12/2017 | Wu | |
| 2018/0047340 | A1* | 2/2018 | Morita | G09G 3/2092 |
| 2018/0047362 | A1* | 2/2018 | Morita | G09G 3/20 |
| 2018/0083113 | A1 | 3/2018 | Balakrishnan et al. | |
| 2018/0190829 | A1 | 7/2018 | Song et al. | |
| 2018/0197794 | A1 | 7/2018 | Kang et al. | |
| 2019/0313048 | A1* | 10/2019 | Cheng | H04N 5/378 |
| 2020/0202793 | A1* | 6/2020 | Shi | G09G 3/3258 |
| 2020/0211463 | A1 | 7/2020 | Yue et al. | |

FOREIGN PATENT DOCUMENTS

| | | | | | |
|---|---|---|---|---|---|
| CN | 105427794 | A | | 3/2016 | |
| CN | 105469745 | A | | 4/2016 | |
| CN | 106782319 | A | | 5/2017 | |
| CN | 106960656 | A | * | 7/2017 | G09G 3/3208 |
| CN | 106960656 | A | | 7/2017 | |
| CN | 107424563 | A | | 12/2017 | |
| CN | 107731164 | A | * | 2/2018 | G09G 3/3233 |
| CN | 107731164 | A | | 2/2018 | |

* cited by examiner

PIXEL DRIVE CIRCUIT AND DRIVE METHOD, AND DISPLAY APPARATUS

CROSS-REFERENCE TO RELATED APPLICATIONS

This application is a national phase entry under 35 USC 371 of International Patent Application No. PCT/CN20191082552 filed on Apr. 12, 2019, which claims priority to Chinese Patent Application No. 201810435167.9, filed with the Chinese Patent Office on May 8, 2018, titled "PIXEL DRIVE CIRCUIT AND DRIVE METHOD, AND DISPLAY APPARATUS", which are incorporated herein by reference in their entirety.

TECHNICAL FIELD

The present disclosure relates to the field of display technologies, and in particular, to a pixel drive circuit, a drive method, and a display apparatus.

BACKGROUND

Organic light emitting diode (OLED) display apparatuses have been widely used in various display products including computers, mobile phones and other electronic products due to their advantages such as self-emission, thinning, low power consumption, high contrast, wide color gamut, and flexible display:

SUMMARY

In a first aspect, a pixel drive circuit is provided. The pixel drive circuit includes: a drive unit configured to output a voltage; a boost sub-circuit coupled to the drive unit, and configured to receive and boost the voltage, and output a boosted voltage; and a light-emitting unit coupled to the boost sub-circuit, and configured to receive the boosted voltage.

In some embodiments, the drive unit is a drive transistor, a gate electrode of the drive transistor is coupled to a first node, a first electrode of the drive transistor is coupled to a first voltage terminal, and a second electrode of the drive transistor is coupled to a second node. The light-emitting unit is a light-emitting diode, an anode of the light-emitting diode is coupled to a third node, and a cathode of the light-emitting diode is coupled to a second voltage terminal. The boost sub-circuit includes a capacitor unit and a switch unit. The switch unit is coupled to a third voltage terminal, the second node, the third node, and a first electrode and a second electrode in the capacitor unit. The switch unit is configured to electrically connect the first electrode of the capacitor unit to the second node, and electrically connect the second electrode of the capacitor unit to the third voltage terminal, so as to charge the capacitor unit. The switch unit is further configured to electrically connect the first electrode of the capacitor unit to the third node, and electrically connect the second electrode of the capacitor unit to the second node, so as to boost a voltage at the first electrode of the charged capacitor unit and output the boost voltage to the third node.

In some embodiments, the capacitor unit includes a first capacitor. The switch unit includes a first transistor, a second transistor, a third transistor, and a fourth transistor. A gate electrode of the first transistor is coupled to a first control terminal, a first electrode of the first transistor is coupled to the second node, and a second electrode of the first transistor is coupled to a first electrode of the first capacitor. A gate electrode of the second transistor is coupled to a second control terminal, a first electrode of the second transistor is coupled to the second electrode of the first capacitor, and a second electrode of the second transistor is coupled to the third voltage terminal. A gate electrode of the third transistor is coupled to a third control terminal, a first electrode of the third transistor is coupled to the second node, and a second electrode of the third transistor is coupled to the second electrode of the first capacitor. A gate electrode of the fourth transistor is coupled to a fourth control terminal, a first electrode of the fourth transistor is coupled to the first electrode of the first capacitor, and a second electrode of the fourth transistor is coupled to the third node.

In some embodiments, the first transistor and the second transistor are configured to be simultaneously controlled.

In some embodiments, the third transistor and the fourth transistor are configured to be simultaneously controlled.

In some embodiments, the boost sub-circuit further includes a second capacitor, a first electrode of the second capacitor is coupled to the third node, and a second electrode of the second capacitor is coupled to a fourth voltage terminal.

In some embodiments, the pixel drive circuit further includes a protection resistor coupled in series between the third node and the anode of the light-emitting diode.

In some embodiments, the pixel drive circuit further includes a complementary metal oxide semiconductor (CMOS) sub-circuit and a storage capacitor. The CMOS sub-circuit includes a fifth transistor and a sixth transistor, and structures of the fifth transistor and a structure of the sixth transistor are complementary. A gate electrode of the fifth transistor is coupled to a first scanning signal line, a first electrode of the fifth transistor is coupled to a data signal line, and a second electrode of the fifth transistor is coupled to the first node. A gate electrode of the sixth transistor is coupled to a second scanning signal line, a first electrode of the sixth transistor is coupled to the data signal line, and a second electrode of the sixth transistor is coupled to the first node. A first electrode of the storage capacitor is coupled to the first node, and a second electrode of the storage capacitor is coupled to a fifth voltage terminal.

In some embodiments, the pixel drive circuit further includes a reset transistor. A gate electrode of the reset transistor is coupled to a reset control signal line, a first electrode of the reset transistor is coupled to the second node, and a second electrode of the reset transistor is coupled to a sixth voltage terminal.

In some embodiments, the pixel drive circuit further includes a light-emitting control transistor. A gate electrode of the light-emitting control transistor is coupled to a light-emitting control signal line, a first electrode of the light-emitting control transistor is coupled to the first voltage terminal, and a second electrode of the light-emitting control transistor is coupled to the first electrode of the drive transistor.

In some embodiments, the pixel drive circuit further includes a protection resistor, a complementary metal oxide semiconductor (CMOS) sub-circuit, a storage capacitor, a reset transistor, and a light-emitting control transistor. The protection resistor is coupled in series between the third node and the anode of the light-emitting diode. The CMOS sub-circuit includes a fifth transistor and a sixth transistor, and a structure of the fifth transistor and a structure of the sixth transistor are complementary. A gate electrode of the fifth transistor is coupled to a first scanning signal line, a first electrode of the fifth transistor is coupled to a data signal line, and a second electrode of the fifth transistor is coupled to the first node. A gate electrode of the sixth transistor is coupled to a second scanning signal line, a first electrode of the sixth transistor is coupled to the data signal line, and a second electrode of the sixth transistor is coupled to the first node. A first electrode of the storage capacitor is coupled to the first node, and a second electrode of the storage capacitor is coupled to a fifth voltage terminal. A gate electrode of the reset transistor is coupled to a reset control signal line, a first electrode of the reset transistor is coupled to the second node, and a second electrode of the reset transistor is coupled to a sixth voltage terminal. A gate electrode of the light-emitting control transistor is coupled to a light-emitting control signal line, a first electrode of the light-emitting control transistor is coupled to the first voltage terminal, and a second electrode of the light-emitting control transistor is coupled to the first electrode of the drive transistor.

In some embodiments, the fifth transistor is an N-type transistor, and the sixth transistor is a P-type transistor; or the fifth transistor is a P-type transistor, and the sixth transistor is an N-type transistor.

In some embodiments, the light-emitting diode is an organic light emitting diode (OLED).

In a second aspect, a drive method of a pixel drive circuit is provided. The pixel drive circuit includes a drive unit, a boost sub-circuit coupled to the drive unit, and a light-emitting unit coupled to the boost sub-circuit. The drive method includes: outputting, by the drive unit, a voltage via an output terminal of the drive unit; boosting, by the boost sub-circuit, the voltage; and receiving, by the light-emitting unit, a boosted voltage.

In some embodiments, the drive unit is a drive transistor. A gate electrode of the drive transistor is coupled to a first node, a first electrode of the drive transistor is coupled to a first voltage terminal, a second electrode of the drive transistor is coupled to a second node, and the output terminal is the second electrode of the drive transistor. The light-emitting unit is a light-emitting diode, and the boost sub-circuit includes a capacitor unit coupled between the second node and an anode of the light-emitting diode. Boosting; by the boost sub-circuit, the voltage, includes: controlling a first electrode of the capacitor unit to electrically connect to the second node, and a second electrode of the capacitor unit to electrically connect to a third voltage terminal; so as to charge the capacitor unit; and controlling the second electrode of the capacitor unit to electrically connect to the second node, and the first electrode of the capacitor unit to electrically connect to the anode of the light-emitting diode, so as to boost a voltage at the first electrode of the charged capacitor unit and output the boosted voltage to the anode of the light-emitting diode.

In some embodiments, the boost sub-circuit further includes a switch unit, and the switch unit is coupled to the third voltage terminal, and the first electrode and the second electrode of the capacitor unit. Controlling a first electrode of the capacitor unit to electrically connect to the second node, and a second electrode of the capacitor unit to electrically connect to a third voltage terminal, so as to charge the capacitor unit, includes: controlling, by the switch unit, the first electrode of the capacitor unit to electrically connect to the second node, and the second electrode of the capacitor unit to electrically connect to the third voltage terminal, so as to charge the capacitor unit. Controlling the second electrode of the capacitor unit to electrically connect to the second node, and the first electrode of the capacitor unit to electrically connect to the anode of the light-emitting diode, and so as to boost a voltage at the first electrode of the charged capacitor unit and output the boosted voltage to the anode of the light-emitting diode, includes: controlling, by the switch unit, the first electrode of the capacitor unit to electrically connect to a third node, and the second electrode of the capacitor unit to electrically connect to the second node, so as to boost the voltage at the first electrode of the charged capacitor unit and output the boosted voltage to the third node.

In a third aspect, a display apparatus is provided. The display apparatus includes a plurality of sub-pixels, and each sub-pixel includes the pixel drive circuit according to any one of the above embodiments.

BRIEF DESCRIPTION OF THE DRAWINGS

In order to describe technical solutions in some embodiments of the present disclosure or the related art more clearly, the accompanying drawings to be used in the description of some embodiments or the related art will be introduced briefly. Obviously, the accompanying drawings to be described below are merely some embodiments of the present disclosure, and a person of ordinary skill in the art can obtain other drawings according to these drawings without paying any creative effort.

DETAILED DESCRIPTION

Figure 1:
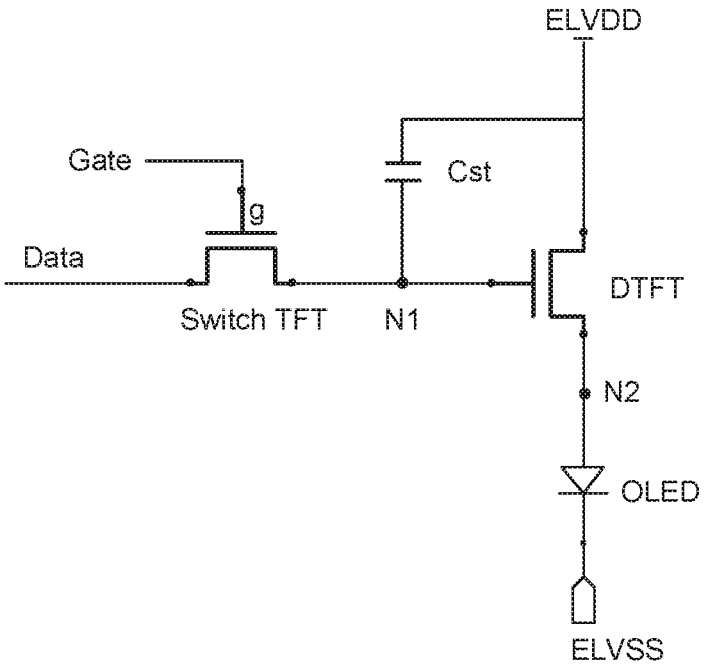
FIG. 1 is a schematic structural diagram of a pixel drive circuit in the related art.

The technical solutions in the embodiments of the present disclosure will be described clearly and completely with reference to the accompanying drawings in the embodiments of the present disclosure. Obviously, the described embodiments are merely some but not all of embodiments of the present disclosure. All other embodiments made on the basis of the embodiments of the present disclosure by a person of ordinary skill in the art without paying any creative effort shall be included in the protection scope of the present disclosure. Unless otherwise defined, technical terms or scientific terms used in the embodiments of the present disclosure shall be understood as ordinary meanings by a person of ordinary skill in the art to which the present disclosure pertains.

The terms "first", "second" and similar terms used in the embodiments of the present disclosure are not intended to mean any order, quantity or importance, and are merely used to distinguish different components. The words "include" or "comprise" and similar words are intended to mean that an element or object that precedes the words includes an element or object listed after the words and equivalents thereof, but other elements or objects are not excluded. The words "connect" or "couple" and similar words are not limited to physical or mechanical connections, but may include electrical connections, whether direct or indirect. The words "upper", "lower", "left", "right", etc. are only used to indicate a relative positional relationship, and when the absolute position of the object to be described is changed, the relative positional relationship may also be changed accordingly.

Core components of an organic light emitting diode (OLED) display apparatus are OLED devices, and the OLED device includes an anode, a light-emitting layer, and a cathode, all of which are sequentially stacked.

A light-emitting principle of the OLED device is that, under driving of an applied electric field, positively charged holes excited from the anode and negatively charged electrons excited from the cathode are recombined in the light-emitting layer to release energy, so that molecules of luminescent materials in the light-emitting layer are excited by the energy to generate a light emission phenomenon.

According to different drive modes, the OLED display apparatuses can be classified into passive drive OLED display apparatuses and active drive OLED display apparatuses.

The passive drive OLED display apparatus may also be referred to as a passive-matrix OLED (PMOLED) display apparatus. In this type of OLED display apparatus, a drive integrated circuit (IC) controls voltages at the cathode and the anode in each sub-pixel through electrode lines, so that an electric field is generated between the cathode and the anode to drive the light-emitting layer between the cathode and the anode to emit light.

In the passive drive OLED display apparatus, since the number of sub-pixels is limited by the number of electrode lines, it is difficult for this type of OLED display apparatus to achieve a high luminance and a high resolution.

The active drive OLED display apparatus may also be referred to as an active-matrix OLED (AMOLED) display apparatus.

In this type of OLED display apparatus, each sub-pixel includes an independent pixel drive circuit, and each pixel drive circuit is at least composed of a transistor having an addressing function (for example, a thin film transistor (TFT)), and a storage capacitor. Under control of an output signal of a drive IC, each pixel drive circuit selectively adjusts a corresponding sub-pixel, thereby achieving independent luminescence of the OLED devices in the sub-pixels. In this way, this type of OLED display apparatus is advantageous to achieving the high luminance and the high resolution.

The related art provides a pixel drive circuit for driving the OLED device to emit light by converting a voltage to a current. As shown in FIG. 1, the pixel drive circuit is composed of two transistors and one storage capacitor (marked as Cst in FIG. 1), and is generally referred to as 2T1C circuit.

In the above two transistors, one is a switch transistor Switch TFT (hereinafter simply referred to as switch TFT), and the other is a drive transistor DTFT (hereinafter simply referred to as drive TFT). The anode of the OLED device is coupled to the drive transistor DTFT through a second node N2, and the cathode of the OLED device is coupled to an electrode power terminal ELVSS.

In this way, after a signal transmitted by a scanning signal line Gate is input to a gate electrode g of the switch TFT, a pixel data signal transmitted by a data signal line Data is input to the switch TFT, so that the drive TFT is turned on to control the OLED device to emit light.

One electrode of the storage capacitor is coupled to the switch TFT through a node N1, and the other electrode is coupled to a power supply voltage terminal ELVDD. By utilizing a charge storage function of the storage capacitor, the sub-pixel including the pixel drive circuit is capable of being driven with only a small drive current in a period of displaying an entire frame, thereby reducing power consumption and extending a service life of materials of the OLED device.

However, a voltage loss is caused due to a body effect of a TFT device itself. For example, the drive TFT has a large voltage loss, which results in a large IR drop of the pixel data signal when the pixel data signal passes through the drive transistor, so that the pixel data signal has a large voltage loss during the transmission of the signal to the OLED device, and a drive current of the OLED device is reduced. Thereby, a luminance of the OLED device may be reduced, which affects a display effect.

Figure 2:
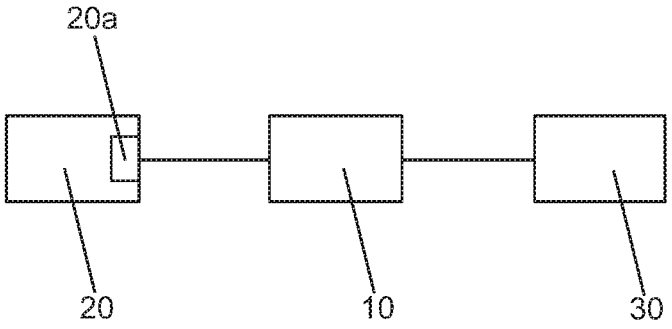
FIG. 2 is a schematic structural diagram of a pixel drive circuit, according to some embodiments of the present disclosure.

Some embodiments of the present disclosure provide a pixel drive circuit. As shown in FIG. 2, the pixel drive circuit includes a drive unit 20, a boost sub-circuit 10 coupled to the drive unit 20, and a light-emitting unit 30 coupled to the boost sub-circuit 10.

The boost sub-circuit 10 is configured to boost a voltage output by the drive unit 20 via an output terminal of the drive unit 20, and the light-emitting unit 30 is configured to receive the boosted voltage.

In this way, by providing the boost sub-circuit 10 between the output terminal of the drive unit 20 and the light-emitting unit 30, the luminance of the light-emitting unit 30 (for example, a light-emitting diode) may be improved, which solves a problem that low luminance of the light-emitting unit caused by voltage loss is difficult to meet the requirement of high luminance display in the related art.

Figure 3:
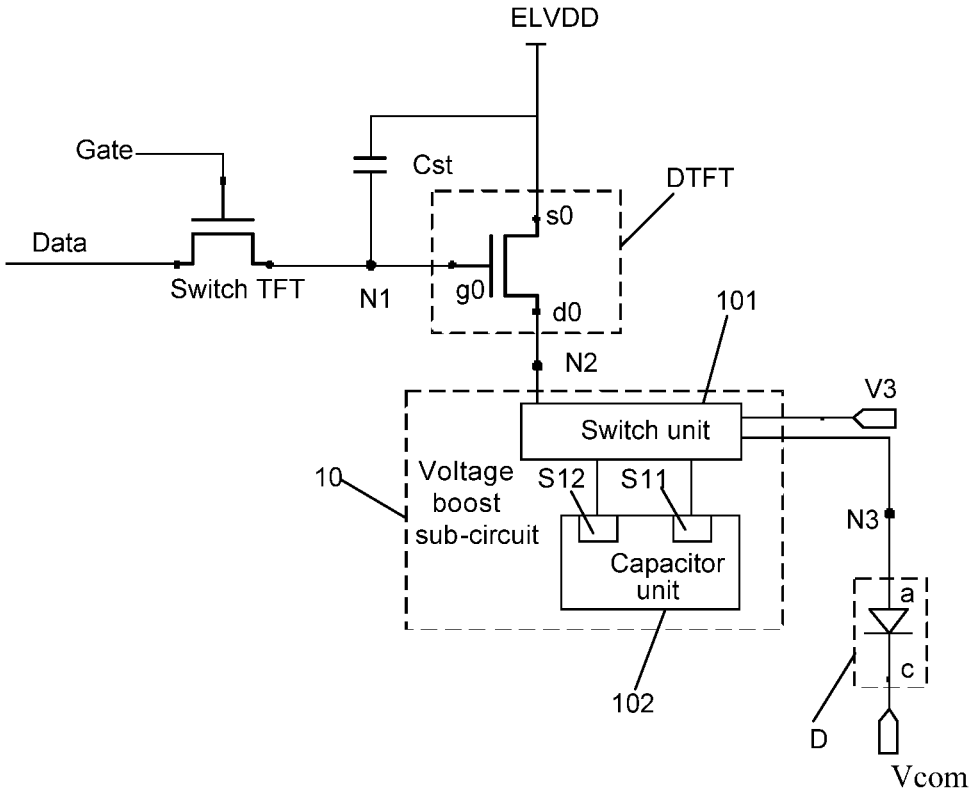
FIG. 3 is a schematic structural diagram of another pixel drive circuit, according to some embodiments of the present disclosure.

Some embodiments of the present disclosure provide a pixel drive circuit. As shown in FIG. 3, in the pixel drive circuit, the drive unit is a drive transistor DTFT. A gate electrode g0 of the drive transistor DTFT is coupled to a first node N1, a first electrode s0 of the drive transistor DTFT is coupled to a first voltage terminal ELVDD, and a second electrode d0 of the drive transistor DTFT is coupled to a second node N2. The aforementioned output terminal is the second electrode d0.

In the pixel drive circuit, the light-emitting unit is a light-emitting diode D. An anode a of the light-emitting diode D is coupled to the boost sub-circuit 10 through a third node N3, and a cathode c is coupled to a second voltage terminal.

Herein, the light-emitting diode D is, for example, an organic electroluminescent diode (i.e., OLED).

The second voltage terminal is used to provide a reference point of a potential, and may be, for example, a common voltage terminal Vcom.

The first voltage terminal is generally a supply voltage terminal and is marked as ELVDD, but some embodiments of the present disclosure are not limited thereto.

In the pixel drive circuit, the boost sub-circuit 10 is coupled to the second node N2. The boost sub-circuit 10 includes a switch unit 101 and a capacitor unit 102, and the switch unit 101 is coupled to a third voltage terminal V3, a first electrode S11 of the capacitor unit 102, and a second electrode S12 of the capacitor unit 102.

The switch unit 101 is configured to electrically connect the first electrode S11 of the capacitor unit 102 to the second node N2, and electrically connect the second electrode S12 of the capacitor unit 102 to the third voltage terminal V3, so as to charge the capacitor unit 102.

The switch unit 101 is further configured to electrically connect the first electrode S11 of the capacitor unit 102 to the third node N3, and electrically connect the second electrode S12 of the capacitor unit 102 to the second node N2, so as to boost a voltage at the first electrode S11 of the charged capacitor unit 102 and output the boosted voltage to the third node N3.

In this way, as shown in FIG. 3, the switch unit 101 establishes electrical continuity between the first electrode S11 of the capacitor unit 102 and the second node N2, and establishes electrical continuity between the second electrode S12 of the capacitor unit 102 and the third voltage terminal V3, so as to charge the capacitor unit 102. Since before the voltage at the first electrode S11 is boosted, the first electrode S11 is electrically connected with the second node N2, the voltage at the first electrode S11 is equal to a voltage at the second node N2. In addition, since the second node N2 is coupled to the second electrode d0 of the drive transistor DTFT, the voltage at the first electrode S11 is equal to a voltage at the second electrode d0 of the drive transistor DTFT.

Moreover, the switch unit 101 is further configured to boost the voltage at the first electrode S11 (i.e., the voltage at the second node N2) of the charged capacitor unit 102 and output the boosted voltage to the third node N3 by controlling the first electrode S11 of the capacitor unit 102 to electrically connect with the third node N3, and the second electrode S12 of the capacitor unit 102 to electrically connect with the second node N2. In this way, the voltage at the first electrode S11 that is used as an input voltage is increased and then output, that is, the voltage at the first electrode S11 is boosted.

It will be understood that the first electrode S11 and the second electrode S12 of the capacitor unit 102 refer to different electrodes with different voltages.

For example, in a case where the capacitor unit 102 includes one capacitor, the first electrode S11 and the second electrode S12 are two electrodes of the capacitor in the capacitor unit 102. Or, in a case where the capacitor unit 102 includes a plurality of capacitors, the first electrodes S11 and second electrodes S12 are different electrodes of different capacitors in the capacitor unit 102. The number of the first electrodes S11 and the number of the second electrodes S12 are not limited in some embodiments of the present disclosure, which may depend on a structure of the capacitor unit 102 and a connection relationship of structures in the capacitor unit 102.

In an example where the light-emitting diode D is an OLED, for the pixel drive circuit, by providing the boost sub-circuit 10 between the second node N2 and the anode a of the light-emitting diode D, a purpose of improving the luminance of the OLED may be achieved. Other circuit structures in the pixel drive circuit are not specifically limited in some embodiments of the present disclosure, and the related circuit structures in the pixel drive circuit may be flexibly designed according to actual needs.

For example, FIG. 3 illustrates one structure of the pixel drive circuit. The pixel drive circuit further includes a switch transistor Switch TFT. The data signal line Data is coupled to the first node N1 through the switch transistor Switch TFT, and the first electrode s0 of the drive transistor DTFT is directly coupled to the first voltage terminal.

In summary, in the pixel drive circuit provided by some embodiments of the present disclosure, the boost sub-circuit including the switch unit and the capacitor unit is disposed between the anode of the light-emitting diode and the second node coupled to the second electrode of the drive transistor DTFT. The switch unit controls the first electrode of the capacitor unit to electrically connect with the second node, and the second electrode of the capacitor unit to electrically connect with the third voltage terminal, so as to charge the capacitor unit.

Moreover, after charging of the capacitor unit is completed, according to a principle that voltages at two ends of the capacitor cannot be abruptly changed, the switch unit controls the first electrode of the capacitor unit to electrically connect with the third node, and the second electrode of the capacitor unit to electrically connect with the second node, so that the voltage at the first electrode (i.e., the voltage at the second node) of the charged capacitor unit is boosted (i.e., increased), and output to the anode of the light-emitting diode through the third node. Thereby, the luminance of the light-emitting diode (for example, the OLED) is improved, and the problem that the low luminance of the light-emitting unit caused by voltage loss is difficult to meet the requirement of high luminance display in the related art is solved.

Figure 4:
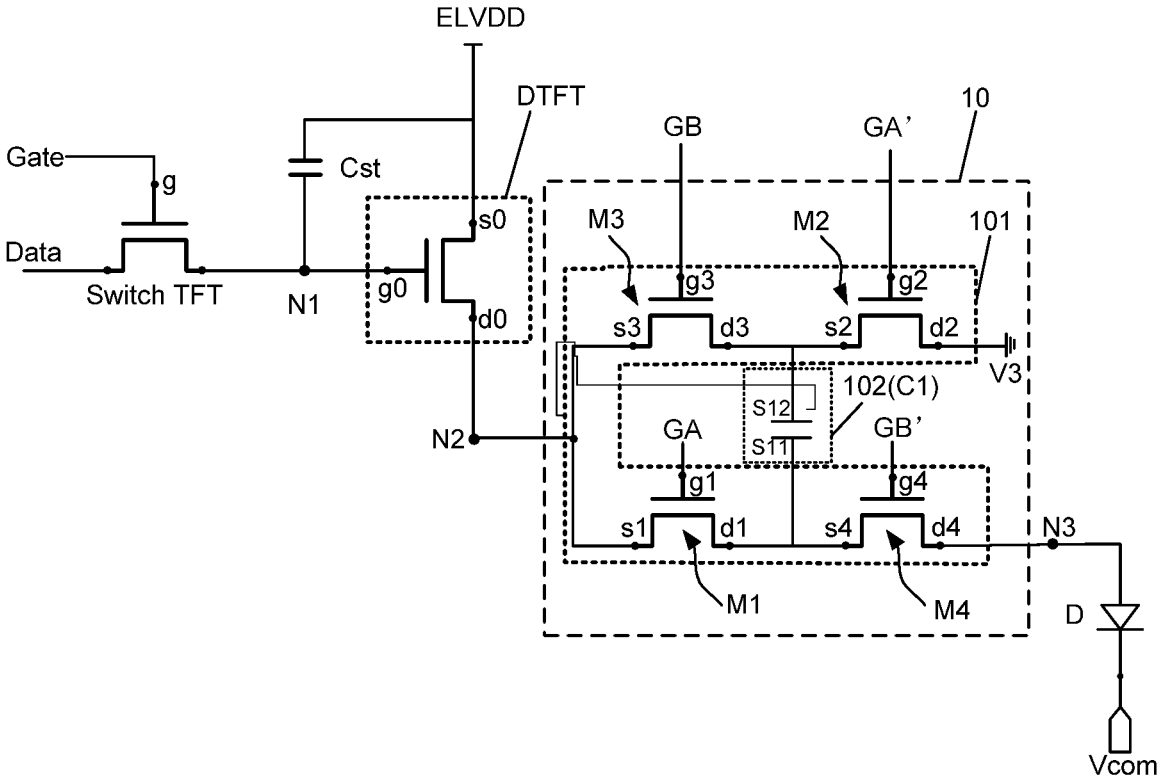
FIG. 4 is a schematic structural diagram of yet another pixel drive circuit, according to some embodiments of the present disclosure.

In some embodiments of the present disclosure, as shown in FIG. 4, a pixel drive circuit is provided. In the pixel drive circuit, structures of the switch transistor Switch TFT, the drive transistor DTFT and the light-emitting diode D, and connection relationships between the switch transistor Switch TFT, the drive transistor DTFT and the light-emitting diode D, may refer to the foregoing description, which will not be described herein again.

As shown in FIG. 4, in the boost sub-circuit 10, the capacitor unit 102 includes a first capacitor C1.

In this case, the first electrode S11 and the second electrode S12 of the capacitor unit 102 are two electrodes of the first capacitor C1 (also referred to as two ends).

The switch unit 101 includes a first transistor M1, a second transistor M2, a third transistor M3, and a fourth transistor M4.

A gate electrode g1 of the first transistor M1 is coupled to a first control terminal GA, a first electrode s1 of the first transistor M1 is coupled to the second node N2, and a second electrode d1 of the first transistor M1 is coupled to the first electrode S11 of the first capacitor C1.

A gate electrode g2 of the second transistor M2 is coupled to a second control terminal GA', a first electrode s2 of the second transistor M2 is coupled to the second electrode S12 of the first capacitor C1, and a second electrode d2 of the second transistor M2 is coupled to the third voltage terminal V3.

Herein, the third voltage terminal V3 is used to provide a reference point of a potential, which can be set as a ground terminal.

A gate electrode g3 of the third transistor M3 is coupled to a third control terminal GB, a first electrode s3 of the third transistor M3 is coupled to the second node N2, and a second electrode d3 of the third transistor M3 is coupled to the second electrode S12 of the first capacitor C1.

A gate electrode g4 of the fourth transistor M4 is coupled to a fourth control terminal GB', a first electrode s4 of the fourth transistor M4 is coupled to the first electrode S11 of the first capacitor C1 and the second electrode d4 of the fourth transistor M4 is coupled to the third node N3.

Herein, it will be noted that the first transistor M1, the second transistor M2, the third transistor M3 and the fourth transistor M4 in the switch unit 101 are all used as switches to realize a turn-on/turn-off of corresponding circuits. It will be understood that specific setting forms of the switches are not limited in some embodiments of the present disclosure, as long as the turn-on/turn-off of the corresponding circuits (that is, the circuits located at positions of M1, M2, M3 and M4), can be realized.

Herein, some embodiments of the present disclosure adopt the transistor to implement the function of the switch, so that the transistors in the boost sub-circuit 10 and other transistors (for example, the aforementioned switch transistor Switch TFT and the drive transistor DTFT) in the pixel drive circuit that do not belong to the boost sub-circuit 10 may be manufactured in a same manufacturing process. In this way, a process of manufacturing the pixel drive circuit may be simplified.

In the following, a principle will be described in detail, that the voltage at the second node N2 is boosted and output to the third node N3 by using the first capacitor C1, and turning on or turning off the first transistor M1 the second transistor M2, the third transistor M3 or the fourth transistor M4.

The boost sub-circuit 10 is equivalent to a charge pump, and the voltage conversion is implemented in two phases.

In a first phase, the first transistor M1 and the second transistor M2 are turned on, and the third transistor M3 and the fourth transistor M4 are turned off. The first capacitor C1 is charged to the input voltage. The specific process is as follows.

The first transistor M1 is controlled to be turned on by the first control terminal GA, and the second transistor M2 is controlled to be turned on by the second control terminal GA' (at this time, the third transistor M3 and the fourth transistor M4 are turned off). In this way, the first electrode S11 of the first capacitor C1 is coupled to the second node N2, and the second electrode S12 of the first capacitor C1 is coupled to the third voltage terminal V3, so as to charge the first capacitor C1.

For the sake of simplicity, in the pixel drive circuit, the first transistor M1 and the second transistor M2 are the transistors of which channel currents are equal or very close when turned on.

In this case, the voltage at the first electrode S11 is $(V_{N2}-I_A\times R_{M1})$, and the voltage at the second electrode S12 is $(I_A\times R_{M2})$, A voltage difference between the two ends of the first capacitor C1 is $[V_{N2}-I_A\times(R_{M1}+R_{M2})]$.

Herein, $V_{N2}$ is a voltage at the second node N2, $I_A$ is the channel current when the first transistor M1 and the second transistor M2 are turned on, and $R_{M1}$ and $R_{M2}$ are the resistances of the first transistor M1 and the second transistor M2 respectively.

In a second phase, the first transistor M1 and the second transistor M2 are turned off, and the third transistor M3 and the fourth transistor M4 are turned on. By utilizing a characteristic that the amount of the charge stored by the capacitor is not abruptly changed, an output voltage turns to be greater than the input voltage, so as to achieve an increase of a voltage. The specific process is as follows.

The third transistor M3 is controlled to be turned on by the third control terminal GB, and the fourth transistor M4 is controlled to be turned on by the fourth control terminal GB' (at this time, the first transistor M1 and the second transistor M2 are turned off), so that the first electrode S11 of the first capacitor C1 is coupled to the third node N3, and the second electrode S12 of the first capacitor C1 is coupled to the second node N2.

For the sake of simplicity, in the pixel drive circuit, the third transistor M3 and the fourth transistor M4 are the transistors of which channel currents are equal or very close when turned on.

In this case, the voltage at the second electrode S12 is changed from the voltage of $(I_A\times R_{M2})$ after charging is completed to a voltage of $(V_{N2}-I_B\times R_{M3})$. That is, a voltage variation amount is $(V_{N2}-I_B\times R_{M3}-I_A\times R_{M2})$.

Due to the characteristics of the capacitor itself (i.e., the amount of the charge stored in the capacitor is not abruptly changed), the voltage at the first electrode S11 also has a same variation amount correspondingly. The voltage of $(V_{N2}-I_A\times R_{M1})$ in the first phase after charging is completed is changed to $[2V_{N2}-I_A\times(R_{M1}+R_{M2})-I_B\times R_{M3}]$.

Herein, $I_B$ is the channel current (which is approximately equal to $I_A$ in general case) in a case where the third transistor M3 and the fourth transistor M4 are turned on. $R_{M3}$ and $R_{M4}$ are the resistances of the third transistor M3 and the fourth transistor M4 respectively.

That is, the voltage at the first electrode S11 also has the same variation amount correspondingly, so that the voltage of $(V_{N2}-I_A\times R_{M1})$ in the first phase after charging is completed is changed to $[2V_{N2}-I_A\times(R_{M1}R_{M2}+R_{M2}+R_{M3})]$, and is output to the third node N3 through the fourth transistor M4.

At this time, the voltage at the third node N3 is $[2V_{N2}-I_A\times(R_{M1}+R_{M2}+R_{M3}+R_{M4})]$.

Herein, the values of $R_{M1}$, $R_{M2}$, $R_{M3}$ and $R_{M4}$ are usually small, so the above formula $[2V_{N2}-I_A\times(R_{M1}+R_{M2}+R_{M3}+R_{M4})]$ may be approximately regarded as $2V_{N2}$.

In this way, the voltage $V_{N2}$ at the second node N2 may be illustratively increased to be close to $2V_{N2}$ by using the boost sub-circuit (that is, the output voltage is boosted to about 2 times the input voltage), and output to the third node N3. Thereby the luminance of the OLED is improved, and the problem that the low luminance of the light-emitting unit caused by voltage loss is difficult to meet the requirement of high luminance display in the related art is solved.

In addition, as will be seen from the above description, in a case where the first transistor M1 is turned on, the second transistor M2 is also turned on; conversely, in a case where the first transistor M1 is turned off, the second transistor M2 is also turned off. That is, in the pixel drive circuit, the first transistor M1 and the second transistor M2 are simultaneously turned on or turned off.

Therefore, the first control terminal GA for controlling the first transistor M1 and the second control terminal GA' for controlling the second transistor M2 may be coupled to a same control signal line. In this way, the first transistor M1 and the second transistor M2 may be simultaneously controlled to simplify the design of the circuit.

Similarly, in a case where the third transistor M3 is turned on, the fourth transistor M4 is also turned on; conversely, in a case where the third transistor M3 is turned off, the fourth transistor M4 is also turned off. That is, in the pixel drive circuit, the third transistors M3 and the fourth transistor M4 are simultaneously turned on or turned off.

Therefore, the third control terminal GB for controlling the third transistor M3 and the fourth control terminal GB' for controlling the fourth transistor M4 may be coupled to a same control signal line. In this way, the third transistor M3 and the fourth transistor M4 may be simultaneously controlled.

Of course, it will be understood that the control signal line that is coupled to the first transistor M1 and the second transistor M2, and the control signal line that is coupled to the third transistor M3 and the fourth transistor M4 are different control signal lines for outputting different signals.

For example, the two control signal lines are configured to each output a pulse signal that does not overlap with a pulse signal output from the other.

Figure 5:
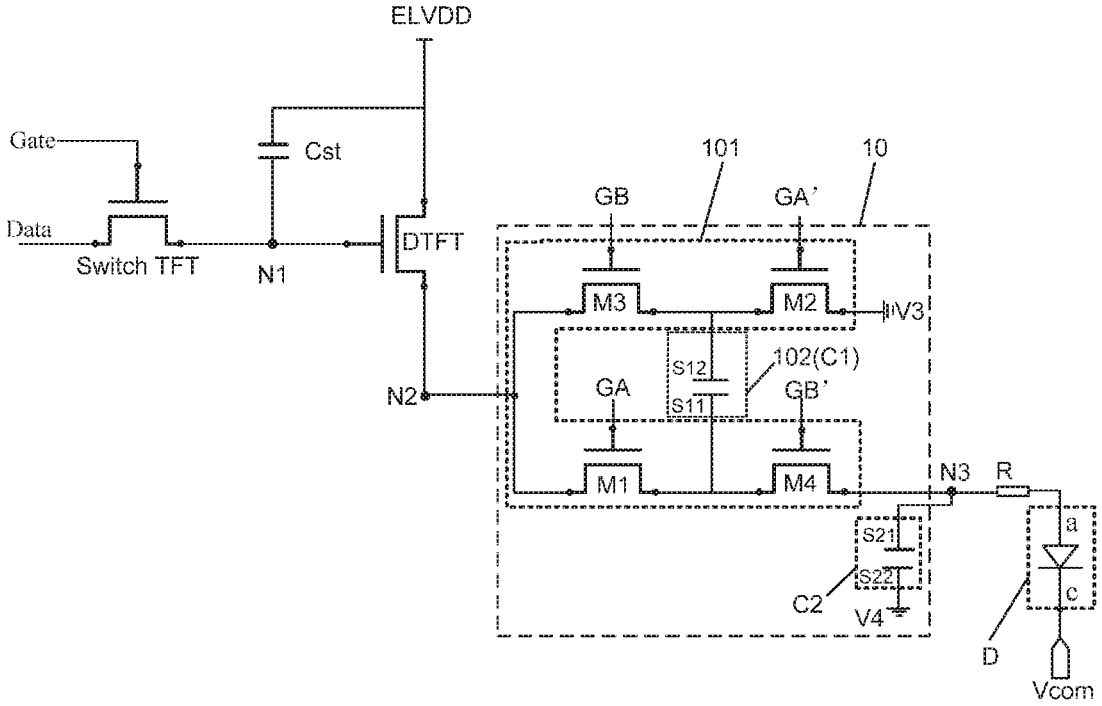
FIG. 5 is a schematic structural diagram of yet another pixel drive circuit, according to some embodiments of the present disclosure.

On this basis, as shown in FIG. 5, for example, the boost sub-circuit 10 in the pixel drive circuit further includes a second capacitor C2.

A first electrode S21 (also referred to as a first end) of the second capacitor C2 is coupled to the third node N3, and a second electrode S22 (also referred to as a second end) of the second capacitor C2 is coupled to a fourth voltage terminal V4. Since the fourth voltage terminal V4 is used to provide a reference point of a potential, the fourth voltage terminal V4 may be set as a ground terminal.

In this way, the voltage at the third node N3 may be stored by the second capacitor C2, and voltage compensation may be performed in a case where there is no input signal at the third node N3. That is, the third node N3 is charged by the second capacitor C2 to maintain the voltage at the third node N3 (this voltage is used as the pixel voltage). In this way, the voltage at the third node N3 may be effectively maintained for a period of displaying a frame after the pixel drive circuit is applied to a display apparatus, and the stability of a displayed image may be ensured.

In the pixel drive circuit provided by some embodiments of the present disclosure, the aforementioned boost sub-circuit 10 is disposed between the second node N2 and the anode of the light-emitting diode D, so that the boosted voltage is input to the light-emitting diode D. Other related circuit structures of the pixel drive circuit are not limited.

As an example, circuit structures of parts of the pixel drive circuit are described in detail below.

In order to prevent the light-emitting diode D (for example, the OLED) from being damaged due to an excessive voltage, for example, as shown in FIG. 5, the pixel drive circuit further includes a protection resistor R coupled in series between the third node N3 and the anode of the light-emitting diode D to stabilize the voltage at the anode of the light-emitting diode D, and avoid damage to the light-emitting diode D.

Figure 6:
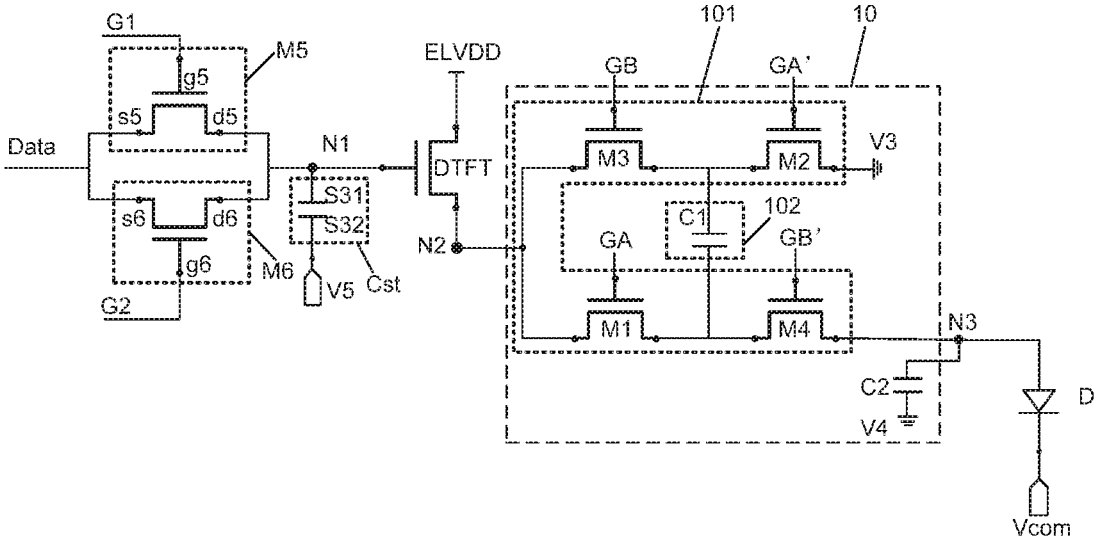
FIG. 6 is a schematic structural diagram of yet another pixel drive circuit, according to some embodiments of the present disclosure.

For example, as shown in FIG. 6, the pixel drive circuit further includes a complementary metal oxide semiconductor (CMOS) sub-circuit. The CMOS sub-circuit includes a fifth transistor M5 and a sixth transistor M6, and a structure of the fifth transistor M5 and a structure of the sixth transistor M6 are complementary.

That is, the CMOS sub-circuit is composed of the fifth transistor M5 and the sixth transistor M6 that are complementary.

A gate electrode g5 of the fifth transistor M5 is coupled to a first scanning signal line G1, a first electrode s5 of the fifth transistor M5 is coupled to the data signal line Data, and a second electrode d5 of the fifth transistor M5 is coupled to the first node N1.

A gate electrode g6 of the sixth transistor M6 is coupled to a second scanning signal line G2, a first electrode s6 of the sixth transistor M6 is coupled to the data signal line Data, and a second electrode d6 of the sixth transistor M6 is coupled to the first node N1.

It will be understood that the expression "a structure of the fifth transistor M5 and a structure of the sixth transistor M6 are complementary" means that one is an N-type transistor and the other is a P-type transistor.

That is, in a case where the fifth transistor M5 is the N-type transistor, the sixth transistor M6 is the P-type transistor; conversely, in a case where the fifth transistor M5 is the P-type transistor, the sixth transistor M6 is the N-type transistor.

Moreover, as shown in FIG. 6, the pixel drive circuit further includes a storage capacitor Cst. A first electrode S31 (also referred to as a first end) of the storage capacitor Cst is coupled to the first node N1, and a second electrode S32 (also referred to as a second end) of the storage capacitor Cst is coupled to a fifth voltage terminal V5.

In this way, in the pixel drive circuit, the CMOS sub-circuit composed of the fifth transistor M5 and the sixth transistor M6 that are complementary is disposed between the data signal line Data and the first node N1 to store the pixel voltage input by the data signal line Data. Therefore, in a case where no pixel voltage is input, voltage compensation may be performed on the drive transistor DTFT to realize a source follow of the drive transistor DTFT, and reduce leakage current. Thereby, the light-emitting diode D may emit light normally in a period of displaying a frame.

The fifth voltage terminal V5 may be a ground terminal or other voltage terminals. For example, referring to FIGS. 3-5, the fifth voltage terminal V5 is the first voltage terminal ELVDD, which is not specifically limited in some embodiments of the present disclosure.

In a case where the pixel drive circuit provided by the related art is applied to a display apparatus, the display apparatus includes a plurality of sub-pixels, and each sub-pixel includes a pixel drive circuit, due to a limited precision of a manufacturing process, it is difficult to achieve that the structures and sizes of the drive transistors DTFT in the pixel drive circuits are completely the same. Therefore, the drive transistors DTFT in pixel drive circuits have different threshold voltages due to slight differences of the structures and sizes of the drive transistors DTFT in the pixel drive circuits. Therefore, in a case where the pixel drive circuits provided by the related art are applied to a display apparatus, changes in currents are generated due to the different threshold voltages, which affect the light emission of the light-emitting diodes D, and an image displayed by the display apparatus may have an uneven luminance problem.

Figure 7:
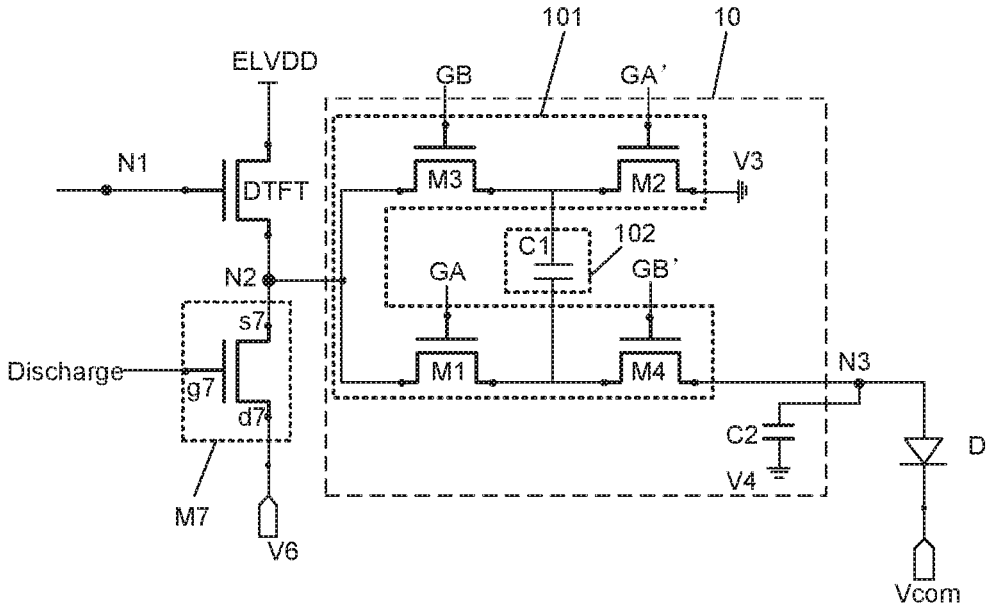
FIG. 7 is a schematic structural diagram of yet another pixel drive circuit, according to some embodiments of the present disclosure.

For example, as shown in FIG. 7, the pixel drive circuit further includes a reset transistor M7. A gate electrode g7 of the reset transistor M7 is coupled to a reset control signal line Discharge, a first electrode s7 of the reset transistor M7 is coupled to the second node N2, and a second electrode d7 of the reset transistor M7 is coupled to a sixth voltage terminal V6.

Generally, the sixth voltage terminal V6 is a ground terminal, but is not limited thereto.

Before the drive transistor DTFT drives the light-emitting diode D to emit light, the pixel drive circuit provided by some embodiments of the present disclosure is capable of controlling the reset transistor M7 to be turned on through the reset control signal line Discharge and resetting the second node N2 through the sixth voltage terminal V6, thereby avoiding the problem of uneven luminance of a display image due to changes of currents which are caused by different threshold voltages.

Figure 8:
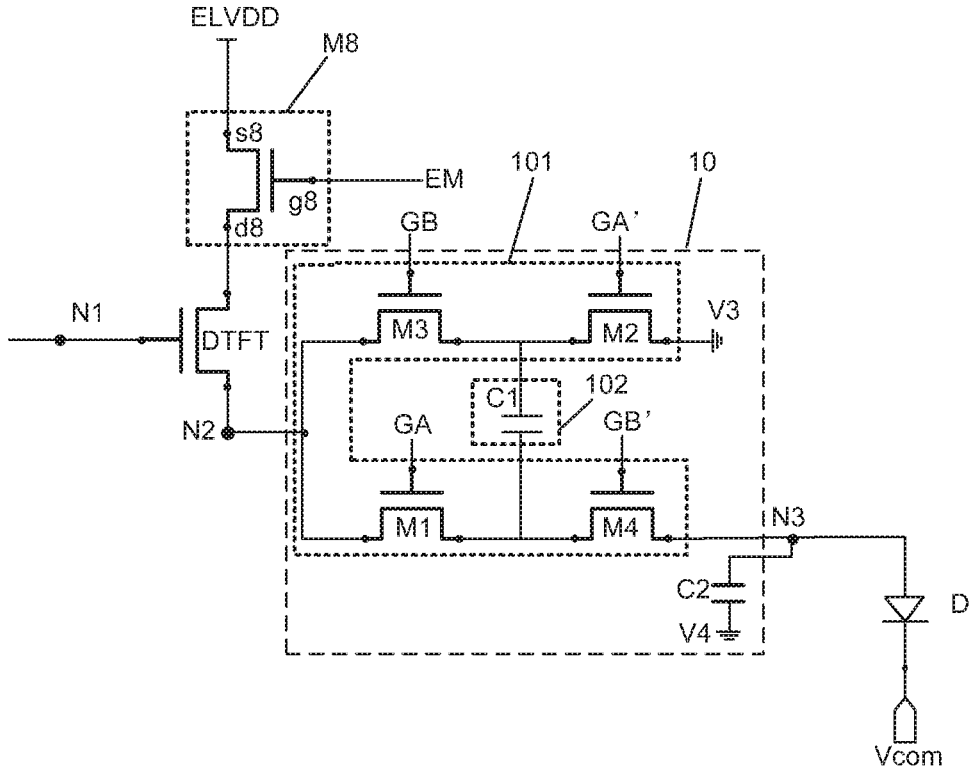
FIG. 8 is a schematic structural diagram of yet another pixel drive circuit, according to some embodiments of the present disclosure.

For example, as shown in FIG. 8, the pixel drive circuit further includes a light-emitting control transistor M8. A gate electrode g8 of the light-emitting control transistor M8 is coupled to a light-emitting control signal line EM, a first electrode s8 of the light-emitting control transistor M8 is coupled to the first voltage terminal ELVDD, and a second electrode d8 of the light-emitting control transistor M8 is coupled to the first electrode s0 of the drive transistor DTFT.

In this way, by adjusting the light-emitting control transistor M8 and a voltage at the second voltage terminal Vcom coupled to the light-emitting diode D, the influence on the current that flows through the light-emitting diode D due to different threshold voltages is reduced. Thereby, the problem of uneven luminance of the display image due to the changes of currents which are caused by the different threshold voltages may be avoided.

It will be understood that, the pixel drive circuit may include any one of the protection resistor R, the CMOS sub-circuit, the storage capacitor Cst, the reset transistor M7, and the light-emitting control transistor M8 that are described above, or may include some or all of the protection resistor R, the CMOS sub-circuit, the storage capacitor Cst, the reset transistor M7, and the light-emitting control transistor M8. Some embodiments of the present disclosure are not limited thereto, and the above parts may be flexibly set according to actual needs of the pixel drive circuit.

Figure 9:
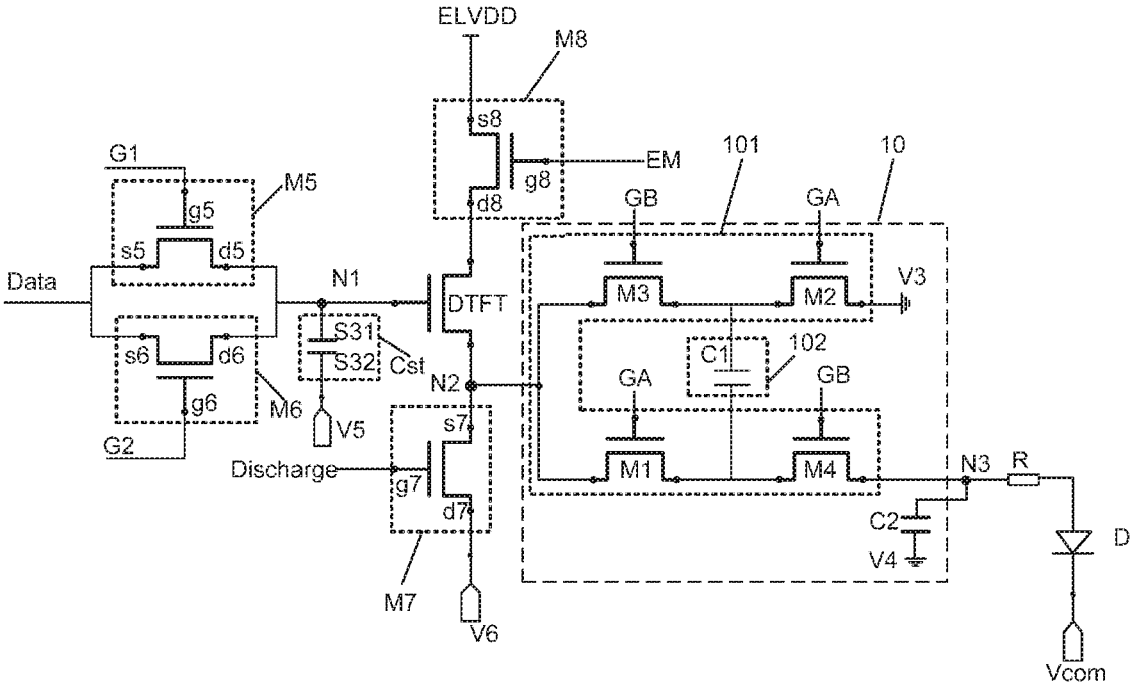
FIG. 9 is a schematic structural diagram of yet another pixel drive circuit, according to some embodiments of the present disclosure.

Of course, as an example, as shown in FIG. 9, in the pixel drive circuit provided by some embodiments of the present disclosure, on the basis that the boost sub-circuit 10 includes the first capacitor C1, the second capacitor C2, the first transistor M1 the second transistor M2, the third transistor M3, and the fourth transistor M4, the pixel drive circuit further includes the protection resistor R, the CMOS sub-circuit, the storage capacitor Cst, the reset transistor M7, and the light-emitting control transistor M8 that are described above. A specific connection relationship of the circuit structures may refer to the foregoing description, which will not be described herein again.

Figure 10:
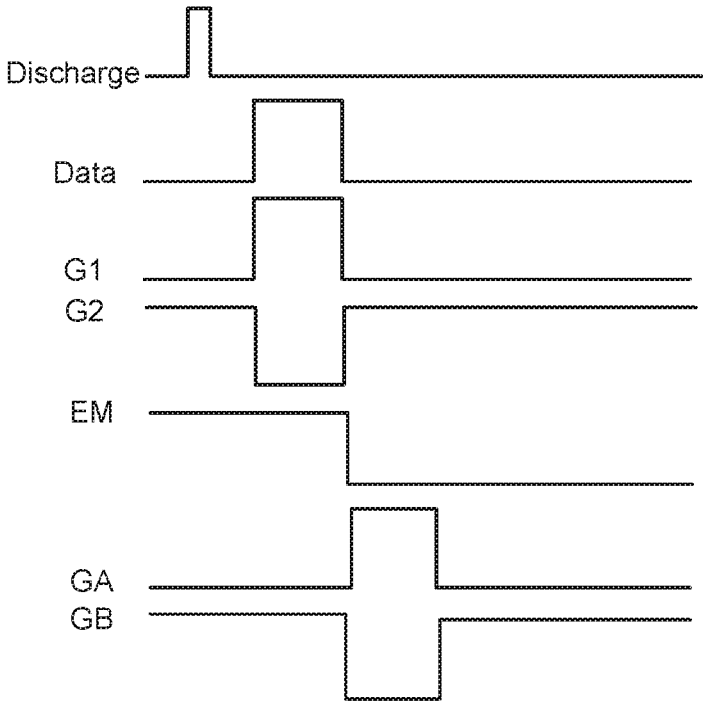
FIG. 10 is a diagram showing timing control of a pixel drive circuit, according to some embodiments of the present disclosure.

Taking a pixel drive circuit illustrated in FIG. 9 as an example in the following, an entire drive process of the pixel drive circuit is further described in combination with timing signals in FIG. 10.

It will be understood that, in the pixel drive circuit illustrated in FIG. 9, the fifth transistor M5 and the sixth transistor M6 are complementary. That is, one is a P-type transistor and the other is an N-type transistor. The specific types of the remaining transistors may be selected according to actual needs, which is not specifically limited in some embodiments of the present disclosure.

For example, the turn-on and turn-off processes of the transistors will be described in the following by taking an example in which the sixth transistor M6 and the light-emitting control transistor M8 are the P-type transistors, and the other transistors are the N-type transistors. That is, under drive of a high level, the N-type transistors are turned on and the P-type transistors are turned off; under driven of a low level, the N-type transistors are turned off, and the P-type transistors are turned on.

Of course, the sixth transistor M6 and the light-emitting control transistor M8 may be the N-type transistors, and the other transistors are the P-type transistors. In this case, it is only required to invert control signals in FIG. 10, and the specific process will not be described herein again.

In addition, as described above, in order to simplify the circuit design, the first control terminal GA and the second control terminal GA' may be coupled to the same control signal line. That is, the two control terminals may be regarded as a same control terminal (as shown in FIG. 9, both are marked as the first control terminal GA).

Similarly, the third control terminal GB and the fourth control terminal GB' may be coupled to the same control signal line. That is, the two control terminals may be regarded as a same control terminal (as shown in FIG. 9, both are marked as the third control terminal GB).

The specific drive process of the pixel drive circuit includes five main phases as follows: a reset phase, a writing phase, a charging phase, a boost phase, and a light-emitting phase.

In the reset phase:

a high level is input to the reset control signal line Discharge to turn on the reset transistor M7, and thus the sixth voltage terminal V6 resets the second node N2.

In the reset phase, the above reset process may avoid the problem of uneven luminance of a display image due to the changes of currents which are caused by different threshold voltages.

In the writing phase:

a high level is input to the first scanning signal line G1 and a low level is input to the second scanning signal line G2 to turn on the fifth transistor M5 and the sixth transistor M6 respectively, and pixel data transmitted by the data signal line Data are input to the first node N1 through the fifth transistor M5 and sixth transistor M6, and are stored by the storage capacitor Cst.

In the writing phase, voltage compensation may be performed by the storage capacitor Cst in a case where there is no signals transmitted by the data signal line. That is, the first node N1 is charged by the storage capacitor Cst.

In the charging phase:

the drive transistor DTFT is turned on under control of the first node N1 to enable the drive transistor DTFT to achieve the source follow, and the voltage at the second node N2 varies with a voltage at the first node N1; and a low level is input to the light-emitting control signal line EM to control the light-emitting control transistor M8 to be turned on, a high level is input to the first control terminal GA and a low level is input to the second control terminal GB to control the first transistor M1 and the second transistor M2 to be turned on, and at this time, the third transistor M3 and the fourth transistor M4 are turned off. The first capacitor C1 is charged.

In the boost phase:

a low level is input to the first control terminal GA and a high level is input to the second control terminal GB to control the first transistor M1 and the second transistor M2 to be turned off, and control the third transistor M3 and the fourth transistor M4 to be turned on. In this way, the voltage at the first electrode S11 of the first capacitor C1 (that is, the voltage at the second node N2) is boosted and then output to the third node N3.

Herein, a specific principle of boosting the voltage at the first electrode S11 may refer to the foregoing description, which will not be described herein again.

In the boost phase, the voltage at the first electrode S11 (that is, the voltage at the second node N2) is boosted and then output to the third node N3, and the second capacitor C2 is charged. Voltage compensation may be performed in a case where there is no signals input to the third node N3, that is, the second capacitor C2 is discharged to the third node N3.

In the light-emitting phase:

the voltage at the first electrode S11 of the first capacitor C1 is boosted and then output to the third node N3, so as to drive the light-emitting diode to emit light.

In summary, the TFT device itself has the body effect which causes the voltage loss, and in the related art, since the voltage at the second voltage terminal Vcom is limited, it is difficulty to satisfy the high brightness requirement. By using the pixel drive circuit provided by some embodiments of the present disclosure, the data signal voltage (i.e., the pixel data) may be boosted by the boost sub-circuit in the pixel drive circuit. Thereby the high brightness requirement of the light-emitting diode is realized, and structural parameters of the TFT are not changed. The design of the circuit is simple, and in a case where the pixel drive circuit is applied to a display apparatus, a power supply system in the related art may also continue to be used.

Moreover, in the pixel drive circuit provided by some embodiments of the present disclosure, the boost sub-circuit is composed of capacitors and transistors, and a manufacturing process of the boost sub-circuit may be based on a manufacturing process of the pixel drive circuit in the related art, thereby simplifying the manufacturing process. In addition, the boost sub-circuit takes up a small area, and voltage boost may be realized without changing existing devices in the pixel drive circuit.

In addition, the pixel drive circuit provided by some embodiments of the present disclosure has advantages of low output ripple, less electromagnetic interference, and low power consumption on the basis of achieving functions of a brightness adjustment, a contrast adjustment, and a gray scale adjustment.

On this basis, in order to more visually explain the technical effect of implementing voltage boost by using the pixel drive circuit provided by some embodiments of the present disclosure, a drive result of the pixel drive circuit is described in detail through actual computer simulation below.

Figure 11:
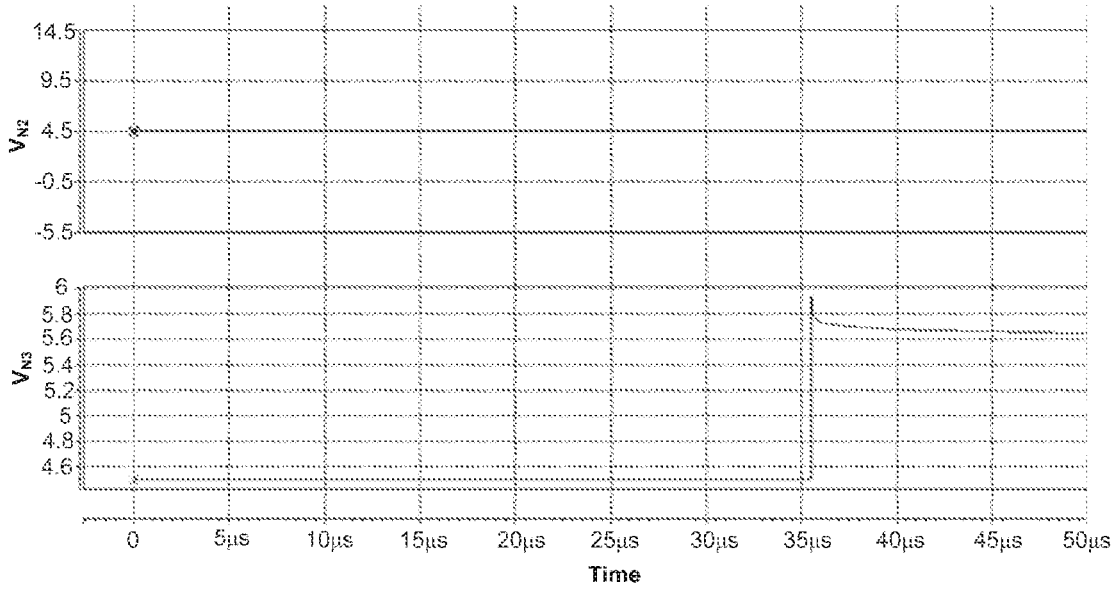
FIG. 11 is a schematic diagram showing simulations of signals of a second node and a third node in a pixel drive circuit, according to some embodiments of the present disclosure.

As shown in FIG. 11, taking an horizontal axis (time) as a reference, a voltage signal away from the horizontal axis is the voltage $V_{N2}$ at the second node N2, and a voltage signal proximate to the horizontal axis is the voltage $V_{N3}$ at the third node N3.

As will be seen from FIG. 11, the voltage $V_{N2}$ at the second node N2 is approximately 4.5V, but after boosted through the boost sub-circuit, the voltage $V_{N3}$ at the third node N3 is boosted from 4.5V to approximately 5.65V.

The simulation result shows that by using the pixel drive circuit provided by some embodiments of the present disclosure, the voltage at the second node N2 may be boosted by nearly 1.15 V, that is, the voltage at the second node N2 is increased by approximately 26%.

Figure 12:
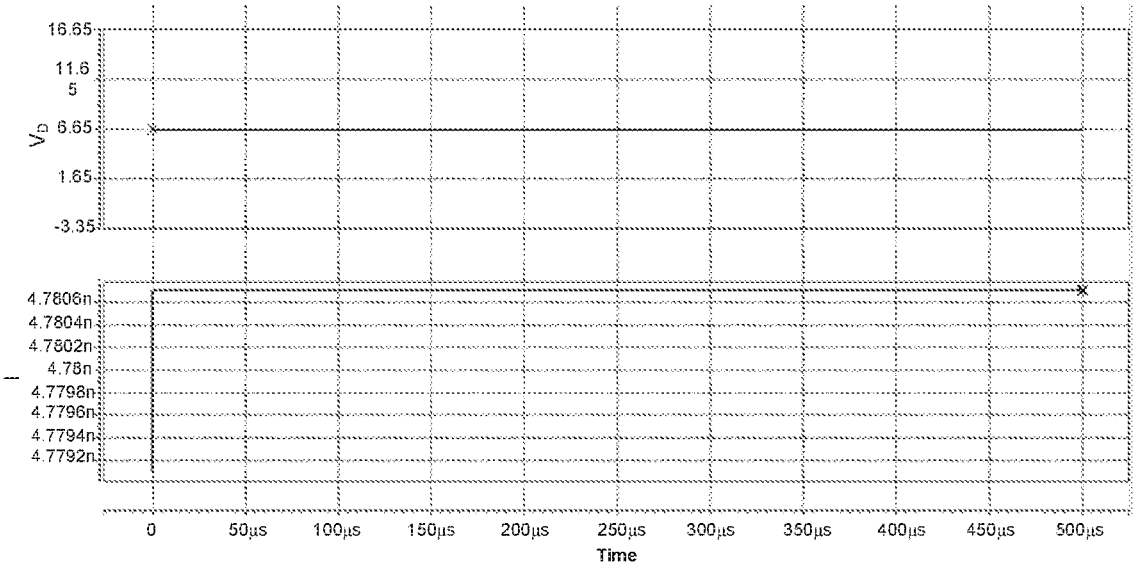
FIG. 12 is a schematic diagram showing simulations of a voltage and a current of a light-emitting diode in a pixel drive circuit, according to some embodiments of the present disclosure.

As shown in FIG. 12, taking the horizontal axis (time) as a reference, a signal away from the horizontal axis is the voltage $V_D$ at the anode of the light-emitting diode D (6.65V), a signal proximate to the horizontal axis is the current I flowing through the light-emitting diode D, and I is 4.78 nA.

Figure 13:
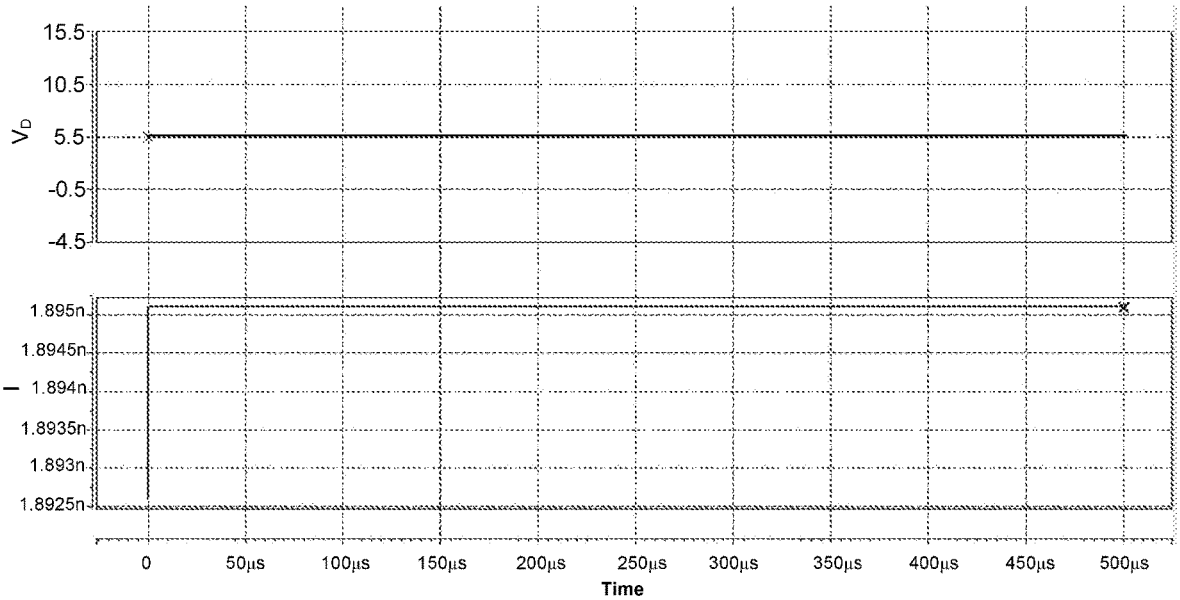
FIG. 13 is a schematic diagram showing simulations of a voltage and a current of a light-emitting diode in a pixel drive circuit in the related art.

Moreover, referring to the simulation result in FIG. 11, the inventors simulated related parameters in a case where there is no boost sub-circuit in the pixel drive circuit in the related art. As shown in FIG. 13, taking the horizontal axis (time) as a reference, a signal away from the horizontal axis is the voltage $V_D$ at the anode of the light-emitting diode D, and the voltage is 5.5V.

Since the pixel drive circuit in the related art does not provide the above boost sub-circuit, that is, voltage boost is not performed, the voltage is reduced by 1.15 V compared to the 6.65 V shown in FIG. 12. Of course, in order to reduce the influence of other factors as much as possible, other related conditions of simulations in the pixel drive circuit in the related art and in the pixel drive circuit provided by some embodiments of the present disclosure can be set as identical as possible.

As will be seen from the above comparison result, a current I (the signal proximate to the horizontal axis in FIG. 13) flowing through the light-emitting diode D in the related art is 1.90 nA. A current I flowing through the light-emitting diode is increased by using the pixel drive circuit provided by some embodiments of the present disclosure. Thus, the current flowing through the light-emitting diode may be increased by using the above pixel drive circuit provided by some embodiments of the present disclosure, and thus the luminance of the light-emitting diode may be increased. Thereby, the high brightness requirement of the light-emitting diode may be met.

Figure 14:
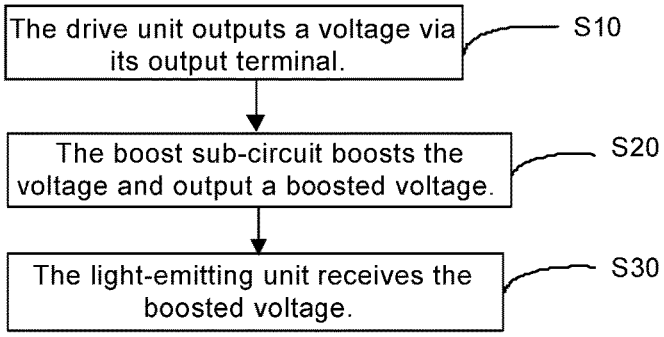
FIG. 14 is a flow diagram of a drive method of a pixel drive circuit, according to some embodiments of the present disclosure.

Some embodiments of the present disclosure further provide a drive method of a pixel drive circuit. The pixel drive circuit includes: a drive unit, a boost sub-circuit coupled to the drive unit, and a light-emitting unit coupled to the boost sub-circuit. As shown in FIG. 14, the drive method includes the following steps S10~S30.

In S10, the drive unit outputs a voltage via its output terminal.

In S20, the boost sub-circuit boosts the voltage and output a boosted voltage.

In S30, the light-emitting unit receives the boosted voltage.

For example, the drive unit is a drive transistor. The gate electrode of the drive transistor is coupled to the first node, the first electrode of the drive transistor is coupled to the first voltage terminal, and the second electrode of the drive transistor is coupled to the second node. The output terminal is the second electrode of the drive transistor. The light-emitting unit is the light-emitting diode, and the boost sub-circuit includes the capacitor unit coupled between the second node and the anode of the light-emitting diode.

Figure 15:
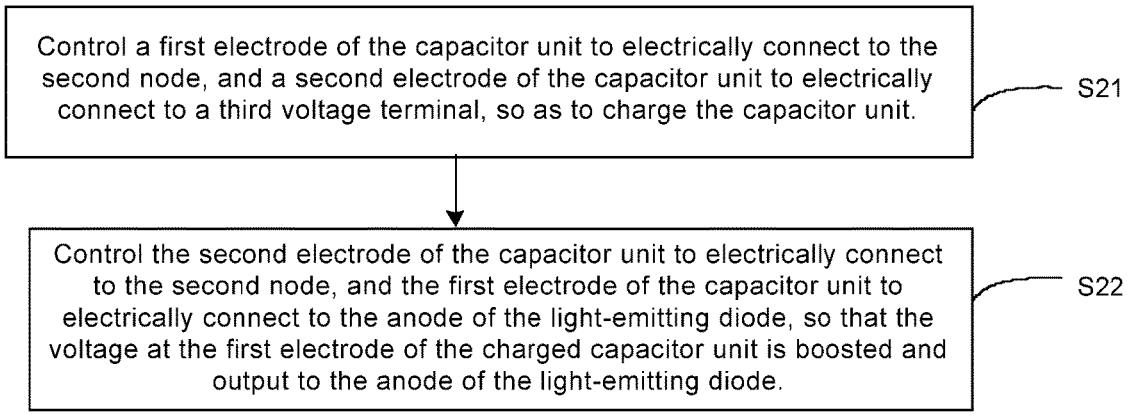
FIG. 15 is another flow diagram of a drive method of a pixel drive circuit, according to some embodiments of the present disclosure.

Correspondingly, in a case where the pixel drive circuit includes the above circuit structure, as shown in FIG. 15, the S20 includes the following steps S21~S22.

In S21, the first electrode of the capacitor unit is controlled to electrically connect to the second node, and the second electrode of the capacitor unit is controlled to electrically connect to the third voltage terminal, so as to charge the capacitor unit.

In S22, the second electrode of the capacitor unit is controlled to electrically connect to the second node, and the first electrode of the capacitor unit is controlled to electrically connect to the anode of the light-emitting diode, so that the voltage at the first electrode of the charged capacitor unit is boosted and output to the anode of the light-emitting diode.

For example, the boost sub-circuit further includes the switch unit, and the switch unit is coupled to the third voltage terminal, and the first electrode and the second electrode of the capacitor unit.

Correspondingly, the S21 includes: controlling, by the switch unit, the first electrode of the capacitor unit to electrically connect to the second node, and the second electrode of the capacitor unit to electrically connect to the third voltage terminal, so as to charge the capacitor unit.

Correspondingly, the S22 includes: controlling, by the switch unit, the first electrode of the capacitor unit to electrically connect to the third node, and the second electrode of the capacitor unit to electrically connect to the second node, so that the voltage at the first electrode of the capacitor unit after being charged is boosted and output to the third node.

Herein, it will be noted that the drive method is not only suitable for the circuit in the pixel drive circuit provided by the foregoing embodiments, that is, a circuit uses a switch unit to control a capacitor unit, but also suitable for other circuits. Those skilled in the art will understand that using other control circuits and program codes to perform the above control to the capacitor unit shall also be included in the protection scope of the present disclosure.

In this way, the drive method is used to control the first electrode of the capacitor unit to electrically connect to the second node, and the second electrode of the capacitor unit to electrically connect to the third voltage terminal, so as to charge the capacitor unit; and control the first electrode of the capacitor unit to electrically connect to the third node, the second electrode of the capacitor unit to electrically connect to the second node, and the voltage at the first electrode (i.e., the voltage at the second node) of the capacitor unit after being charged is boosted and output to the third node (i.e., the anode of the light-emitting diode). Thereby, the luminance of the OLED is improved, and the problem that the low luminance of the OLED caused by voltage loss is difficult to meet the requirement of high luminance display in the related art is solved.

Herein, the specific principle of voltage boost may refer to the foregoing description, which will not be described herein again.

Figure 16:
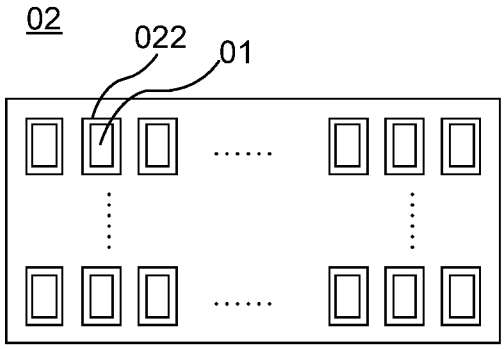
FIG. 16 is a schematic structural diagram of a display apparatus, according to some embodiments of the present disclosure.

Some embodiments of the present disclosure provide a display apparatus. As shown in FIG. 16, the display apparatus 02 includes a plurality of sub-pixels 022, and each sub-pixel 022 includes the above pixel drive circuit 01.

The pixel drive circuit in the display apparatus has the same structure and beneficial effects as the pixel drive circuit provided in the foregoing embodiments. Since the foregoing embodiments have described the structure and beneficial effects of the pixel drive circuit in detail, which will not be described herein again.

It will be noted that, in some embodiments of the present disclosure, the display apparatus may include an organic light-emitting diode (OLED) display panel.

The display apparatus may be any product or component having a display function such as a displayer, a television, a mobile phone, a tablet computer, a digital photo frame or a smart bracelet.

In addition, those skilled in the art will understand that the plurality of sub-pixels in the display apparatus are generally arranged in a matrix. For pixel drive circuits in a row of sub-pixels, the same control terminals are generally coupled to a same signal line. For example, the first control terminals corresponding to the pixel drive circuits in a same row may be coupled to a same control signal line, and the second control terminals corresponding to the pixel drive circuits in a same row may be coupled to a same control signal line. For another example, the pixel drive circuits in the same row are coupled to a same first scanning signal line; of course, pixel drive circuits in a same column are coupled to a same data signal line, etc., and details are not described herein. There are no limitation on the specific connection conditions of the pixel drive circuits in a same row and/or a same column, as long as the display apparatus can display an image normally, which may refer to connection manners of the pixel drive circuits in the same row and/or the same column in the related art.

The foregoing descriptions are merely specific implementation manners of the present disclosure, but the protection scope of the present disclosure is not limited thereto. Any person skilled in the art could readily conceive of changes or replacements within the technical scope of the present disclosure, which shall all be included in the protection scope of the present disclosure. Therefore, the protection scope of the present disclosure shall be subject to the protection scope of the claims.

What is claimed is:

1. A pixel drive circuit, comprising:

a drive transistor configured to output a voltage;

a boost sub-circuit coupled to the drive transistor, and configured to receive and boost the voltage, and output a boosted voltage; and a light-emitting diode coupled to the boost sub-circuit, and configured to receive the boosted voltage; wherein a gate electrode of the drive transistor is coupled to a first node, a first electrode of the drive transistor is coupled to a first voltage terminal, and a second electrode of the drive transistor is coupled to a second node;

an anode of the light-emitting diode is coupled to a third node, and a cathode of the light-emitting diode is coupled to a second voltage terminal;

the boost sub-circuit includes a first capacitor and a switch sub-circuit, wherein the switch sub-circuit is coupled to a third voltage terminal, the second node, the third node, and a first electrode and a second electrode of the first capacitor; the first capacitor is connected to the second node, the third node and the third voltage terminal through the switch sub-circuit;

the switch sub-circuit is configured to electrically connect the first electrode of the first capacitor to the second node, and electrically connect the second electrode of the first capacitor to the third voltage terminal; and the switch sub-circuit is further configured to electrically connect the first electrode of the first capacitor to the third node, and electrically connect the second electrode of the first capacitor to the second node.

2. The pixel drive circuit according to claim 1, wherein the switch sub-circuit includes a first transistor, a second transistor, a third transistor, and a fourth transistor, wherein a gate electrode of the first transistor is coupled to a first control terminal, a first electrode of the first transistor is coupled to the second node, and a second electrode of the first transistor is coupled to a first electrode of the first capacitor;

a gate electrode of the second transistor is coupled to a second control terminal, a first electrode of the second transistor is coupled to a second electrode of the first capacitor, and a second electrode of the second transistor is coupled to the third voltage terminal;

a gate electrode of the third transistor is coupled to a third control terminal, a first electrode of the third transistor is coupled to the second node, and a second electrode of the third transistor is coupled to the second electrode of the first capacitor; and a gate electrode of the fourth transistor is coupled to a fourth control terminal, a first electrode of the fourth transistor is coupled to the first electrode of the first capacitor, and a second electrode of the fourth transistor is coupled to the third node.

3. The pixel drive circuit according to claim 2, wherein the first transistor and the second transistor are configured to be simultaneously controlled.

4. The pixel drive circuit according to claim 2, wherein the third transistor and the fourth transistor are configured to be simultaneously controlled.

5. The pixel drive circuit according to claim 2, wherein the boost sub-circuit further includes a second capacitor, a first electrode of the second capacitor is coupled to the third node, and a second electrode of the second capacitor is coupled to a fourth voltage terminal.

6. The pixel drive circuit according to claim 5, further comprising a protection resistor, a complementary metal oxide semiconductor (CMOS) sub-circuit, a storage capacitor, a reset transistor, and a light-emitting control transistor, wherein the protection resistor is coupled in series between the third node and the anode of the light-emitting diode;

the CMOS sub-circuit includes a fifth transistor and a sixth transistor, and a structure of the fifth transistor and a structure of the sixth transistor are complementary;

a gate electrode of the fifth transistor is coupled to a first scanning signal line, a first electrode of the fifth transistor is coupled to a data signal line, and a second electrode of the fifth transistor is coupled to the first node;

a gate electrode of the sixth transistor is coupled to a second scanning signal line, a first electrode of the sixth transistor is coupled to the data signal line, and a second electrode of the sixth transistor is coupled to the first node;

a first electrode of the storage capacitor is coupled to the first node, and a second electrode of the storage capacitor is coupled to a fifth voltage terminal;

a gate electrode of the reset transistor is coupled to a reset control signal line, a first electrode of the reset transistor is coupled to the second node, and a second electrode of the reset transistor is coupled to a sixth voltage terminal; and a gate electrode of the light-emitting control transistor is coupled to a light-emitting control signal line, a first electrode of the light-emitting control transistor is coupled to the first voltage terminal, and a second electrode of the light-emitting control transistor is coupled to the first electrode of the drive transistor.

7. The pixel drive circuit according to claim 1, wherein the boost sub-circuit further includes a second capacitor, a first electrode of the second capacitor is coupled to the third node, and a second electrode of the second capacitor is coupled to a fourth voltage terminal.

8. The pixel drive circuit according to claim 7, further comprising a protection resistor, a complementary metal oxide semiconductor (CMOS) sub-circuit, a storage capacitor, a reset transistor, and a light-emitting control transistor, wherein the protection resistor is coupled in series between the third node and the anode of the light-emitting diode;

the CMOS sub-circuit includes a fifth transistor and a sixth transistor, and a structure of the fifth transistor and a structure of the sixth transistor are complementary;

a gate electrode of the fifth transistor is coupled to a first scanning signal line, a first electrode of the fifth transistor is coupled to a data signal line, and a second electrode of the fifth transistor is coupled to the first node;

a gate electrode of the sixth transistor is coupled to a second scanning signal line, a first electrode of the sixth transistor is coupled to the data signal line, and a second electrode of the sixth transistor is coupled to the first node;

a first electrode of the storage capacitor is coupled to the first node, and a second electrode of the storage capacitor is coupled to a fifth voltage terminal;

a gate electrode of the reset transistor is coupled to a reset control signal line, a first electrode of the reset transistor is coupled to the second node, and a second electrode of the reset transistor is coupled to a sixth voltage terminal; and a gate electrode of the light-emitting control transistor is coupled to a light-emitting control signal line, a first electrode of the light-emitting control transistor is coupled to the first voltage terminal, and a second electrode of the light-emitting control transistor is coupled to the first electrode of the drive transistor.

9. The pixel drive circuit according to claim 8, wherein the fifth transistor is an N-type transistor, and the sixth transistor is a P-type transistor; or the fifth transistor is a P-type transistor, and the sixth transistor is an N-type transistor.

10. The pixel drive circuit according to claim 1, further comprising a protection resistor coupled in series between the third node and the anode of the light-emitting diode.

11. The pixel drive circuit according to claim 1, further comprising a complementary metal oxide semiconductor (CMOS) sub-circuit and a storage capacitor, wherein the CMOS sub-circuit includes a fifth transistor and a sixth transistor, and a structure of the fifth transistor and a structure of the sixth transistor are complementary;

a gate electrode of the fifth transistor is coupled to a first scanning signal line, a first electrode of the fifth transistor is coupled to a data signal line, and a second electrode of the fifth transistor is coupled to the first node;

a gate electrode of the sixth transistor is coupled to a second scanning signal line, a first electrode of the sixth transistor is coupled to the data signal line, and a second electrode of the sixth transistor is coupled to the first node; and a first electrode of the storage capacitor is coupled to the first node, and a second electrode of the storage capacitor is coupled to a fifth voltage terminal.

12. The pixel drive circuit according to claim 11, wherein the fifth transistor is an N-type transistor, and the sixth transistor is a P-type transistor; or the fifth transistor is a P-type transistor, and the sixth transistor is an N-type transistor.

13. The pixel drive circuit according to claim 1, further comprising a reset transistor, wherein a gate electrode of the reset transistor is coupled to a reset control signal line, a first electrode of the reset transistor is coupled to the second node, and a second electrode of the reset transistor is coupled to a sixth voltage terminal.

14. The pixel drive circuit according to claim 1, further comprising a light-emitting control transistor, wherein a gate electrode of the light-emitting control transistor is coupled to a light-emitting control signal line, a first electrode of the light-emitting control transistor is coupled to the first voltage terminal, and a second electrode of the light-emitting control transistor is coupled to the first electrode of the drive transistor.

15. The pixel drive circuit according to claim 1, wherein the light-emitting diode is an organic light emitting diode (OLED).

16. A display apparatus, comprising a plurality of sub-pixels, wherein each sub-pixel includes the pixel drive circuit according to claim 1.

17. A drive method of a pixel drive circuit including a drive transistor, a boost sub-circuit coupled to the drive transistor, and a light-emitting diode coupled to the boost sub-circuit, wherein a gate electrode of the drive transistor is coupled to a first node, a first electrode of the drive transistor is coupled to a first voltage terminal, a second electrode of the drive transistor is coupled to a second node, and the output terminal is the second electrode of the drive transistor; the boost sub-circuit includes a first capacitor and a switch sub-circuit, wherein the switch sub-circuit is coupled to a third voltage terminal, the second node, a third node, and a first electrode and a second electrode of the first capacitor; the first capacitor is connected to the second node, the third node and the third voltage terminal through the switch sub-circuit;

the drive method comprising:

outputting, by the drive transistor, a voltage via an output terminal of the drive transistor;

controlling, by the switch sub-circuit, the first electrode of the first capacitor to electrically connect to the second node, and the second electrode of the first capacitor to electrically connect to the third voltage terminal, so as to charge the first capacitor;

controlling, by the switch sub-circuit, the first electrode of the first capacitor to electrically connect to a third node, and the second electrode of the first capacitor to electrically connect to the second node, so as to boost the voltage at the first electrode of the charged first capacitor and output the boosted voltage to the third node, and receiving, by the light-emitting diode, the boosted voltage.

18. A pixel drive circuit, comprising:

a drive transistor configured to output a voltage;

a boost sub-circuit coupled to the drive transistor, and configured to receive and boost the voltage, and output a boosted voltage; and a light-emitting diode coupled to the boost sub-circuit, and configured to receive the boosted voltage; wherein a gate electrode of the drive transistor is coupled to a first node, a first electrode of the drive transistor is coupled to a first voltage terminal, and a second electrode of the drive transistor is coupled to a second node;

an anode of the light-emitting diode is coupled to a third node, and a cathode of the light-emitting diode is coupled to a second voltage terminal;

the boost sub-circuit includes a first capacitor and a switch sub-circuit, wherein the switch sub-circuit is coupled to a third voltage terminal, the second node, the third node, and a first electrode and a second electrode of the first capacitor;

the switch sub-circuit is configured to electrically connect the first electrode of the first capacitor to the second node, and electrically connect the second electrode of the first capacitor to the third voltage terminal; and the switch sub-circuit is further configured to electrically connect the first electrode of the first capacitor to the third node, and electrically connect the second electrode of the first capacitor to the second node;

wherein the switch sub-circuit includes a first transistor, a second transistor, a third transistor, and a fourth transistor, wherein a gate electrode of the first transistor is coupled to a first control terminal, a first electrode of the first transistor is coupled to the second node, and a second electrode of the first transistor is coupled to a first electrode of the first capacitor;

a gate electrode of the second transistor is coupled to a second control terminal, a first electrode of the second transistor is coupled to a second electrode of the first capacitor, and a second electrode of the second transistor is coupled to the third voltage terminal;

a gate electrode of the third transistor is coupled to a third control terminal, a first electrode of the third transistor is coupled to the second node, and a second electrode of the third transistor is coupled to the second electrode of the first capacitor; and a gate electrode of the fourth transistor is coupled to a fourth control terminal, a first electrode of the fourth transistor is coupled to the first electrode of the first capacitor, and a second electrode of the fourth transistor is coupled to the third node.

* * * * *